US011852162B2

(12) United States Patent
Shane

(10) Patent No.: US 11,852,162 B2
(45) Date of Patent: Dec. 26, 2023

(54) CENTRIFUGAL PUMP ASSEMBLY

(71) Applicant: Robert Bosch GmbH, Stuttgart (DE)

(72) Inventor: Trevor Shane, Newton Upper Falls, MA (US)

(73) Assignees: Robert Bosch LLC, Farmington Hills, MI (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/555,019

(22) Filed: Dec. 17, 2021

(65) Prior Publication Data

US 2023/0193923 A1 Jun. 22, 2023

(51) Int. Cl.
*F04D 29/42* (2006.01)
*F04D 17/08* (2006.01)

(52) U.S. Cl.
CPC ..... *F04D 29/4206* (2013.01); *F04D 17/08* (2013.01)

(58) Field of Classification Search
CPC ..... F04D 13/06–086; F04D 29/406; F04D 29/426–4293; F04D 29/445; F05D 2210/42; F05D 2250/314; F05D 2250/38; F05D 2250/52
See application file for complete search history.

(56) References Cited

U.S. PATENT DOCUMENTS 2,618,223 A * 11/1952 Ransohoff ..... F04D 29/445 415/206
5,807,073 A 9/1998 Jensen et al.
5,899,662 A * 5/1999 Hojyo ..... F04D 29/445 415/206
6,017,187 A 1/2000 Mueller
6,779,974 B2 * 8/2004 Chien ..... F01D 1/02 415/206
9,103,351 B2 * 8/2015 P ..... F04D 13/02
9,470,242 B2 * 10/2016 Albert ..... D06F 39/085
9,534,601 B2 * 1/2017 Ree ..... F04D 1/06
9,803,653 B2 * 10/2017 Qi ..... F04D 29/22
2005/0196274 A1 * 9/2005 Kraffzik ..... F04D 29/445 415/206
2012/0224961 A1 * 9/2012 Weber ..... F04D 29/588 415/220

FOREIGN PATENT DOCUMENTS

CN 210948917 7/2020
CN 113898612 A * 1/2022
DE 19509255 9/1995
KR 100427067 4/2004

* cited by examiner

*Primary Examiner* — Brian P Wolcott
(74) *Attorney, Agent, or Firm* — Kelly McGlashen; Maginot, Moore & Beck LLP

(57) ABSTRACT

A centrifugal pump assembly includes a pump housing that encloses a rotor unit that includes an impeller. The pump housing includes an inlet that defines a first passageway that is aligned with the rotor rotational axis, an outlet that defines a second passageway that is aligned with a second axis, and a volute that is provided on an inner surface of the pump housing. An exit opening of the volute faces the outlet and at least a portion of the fluid exiting the volute moves along a volute discharge axis. The volute discharge axis is tangential to a portion of fluid flow exiting the volute at the volute exit opening and is offset relative to the rotational axis. When viewed in a direction perpendicular to the first axis, the second axis is acutely angled relative to the volute discharge axis.

19 Claims, 7 Drawing Sheets

CENTRIFUGAL PUMP ASSEMBLY

BACKGROUND

Centrifugal fluid pumps may be used as cooling circuit pumps for motor vehicles. The cooling circuit can be used, for example, to cool a drive motor, a charge air heat exchanger, a battery and/or a control unit of the motor vehicle. For purposes of operational and packaging efficiency, it may be useful to combine multiple components of a vehicle cooling system into a single, integrated module. Such a module may include, for example, the cooling circuit pump, a fluid reservoir, one or more fluid valves, a cooling system controller, sensors, etc. A housing of the module may include internal passageways that permit fluid communication between the various components of the system included in the module. Portions of the module housing may be configured to replace housing elements of certain components. For example, a portion of the module housing may be used to provide a lid of a fluid valve, whereby the fluid valve is connected to the module housing. For other components, the module may be configured to permit the component to "plug into" an appropriately configured portion of the module housing. Regardless of how the component is integrated into the module housing, such integration presents design challenges for the component to be integrated.

SUMMARY

In an exemplary cooling system in which a centrifugal fluid pump is plugged into the housing of an integrated module, appropriate fluid sealing is used prevent fluid leakage between the fluid pump and the corresponding internal passageways of the module housing. In some modules, however, in order to provide appropriate fluid sealing between the housing of the fluid pump and the module housing, the configuration of the pump housing fluid outlet may be modified relative to some conventional pump housings, for example to accommodate the presence of seals between the fluid pump housing and the module housing.

Referring to FIG. 11, in some conventional centrifugal fluid pumps 300, the inflow direction 301 is arranged substantially parallel, in particular coaxially, to the axis of rotation 336 of the pump impeller and that the outflow direction 302 extends in radial direction that is perpendicular to or substantially perpendicular to the rotational axis 336. This enables a particularly compact design of the pump or the pump housing. The use of the term "substantially" is an acknowledgement that some minor variation in relative orientation may occur. In some cases, the variation may be due to manufacturing tolerances, wear of components, etc. In other cases, the variation may be a reflection of the shape of the volute 303 through which fluid passes within the pump housing 304. In some embodiments, the term "substantially" as used herein refers to a direction that is within plus or minus two degrees of being precisely as stated, while in other embodiments the term "substantially" refers to a direction that is within plus or minus five degrees of being precisely as stated.

Unless otherwise stated, the axial direction denotes the axial direction of the fluid pump, which coincides with the rotational axis of the pump impeller. The radial plane is perpendicular to or substantially perpendicular to the axial direction and is parallel to the plane in which the volute of the pump housing extends. A radial direction is to be understood as a direction which extends substantially perpendicular to the axial direction and/or to the axis of rotation. In particular, the radial direction lies in the radial plane.

The fluid pump described herein differs from the conventional fluid pump described above in that the outflow direction of the fluid pump is not substantially perpendicular to the inflow direction, and instead is acutely angled relative to the radial plane. By this configuration, the pump housing fluid outlet accommodates the presence of a seal between the fluid pump housing and the module housing. The outflow from the fluid pump is redirected in the acute angle by a ramp provided within the pump housing fluid outlet. The ramp has a correspondingly angled surface that redirects fluid exiting the volute toward a corresponding internal passageway of the module housing.

In some aspects, a centrifugal pump includes a pump casing that includes a pump housing and a motor pot. An open end of the pump housing is joined to an open end of the motor pot, and the joined pump housing and motor pot define an interior fluid chamber. The pump includes a rotor unit disposed in the fluid chamber. The rotor unit includes a rotor of a motor and an impeller that is connected to the rotor. The rotor is configured to drive the impeller to rotate about a rotational axis. The pump housing includes an inlet that defines a first passageway that is aligned with the rotational axis and directs fluid toward the impeller, and an outlet that defines a second passageway that is aligned with a second axis. The pump housing includes a volute that is provided on an inner surface of the pump housing and that communicates with the inlet and the outlet. The volute defines a spiral fluid path that increases in cross-sectional area along the path so as to have a maximum cross-sectional area at a volute exit opening. The volute exit opening faces the outlet and the volute exit opening discharges at least a portion of the fluid along a volute discharge axis. An end face of the motor pot open end defines a floor surface of the volute. The end face resides in a plane that is substantially perpendicular to the rotational axis. In addition, an inner surface of the outlet has a ramp configured to redirect fluid flow exiting the volute so that the redirected fluid flow is at an acute first angle relative to the plane.

In some embodiments, the ramp has a surface that faces the volute exit opening. The surface is at the first angle relative to the plane.

In some embodiments, when viewed in a direction parallel to the rotational axis, the volute discharge axis is tangential to a portion of fluid flow exiting the volute at the volute exit opening and the second axis is aligned with the volute discharge axis.

In some embodiments, the volute discharge axis is at an acute second angle relative to the plane, and the first angle is greater than the second angle.

In some embodiments, the first angle is at least twice the second angle.

In some embodiments, the first angle is in a range of 5 degrees to 20 degrees.

In some embodiments, a cross-sectional area of the outlet increases along the outlet passageway, and the outlet has a minimum dimension at a location closest to the volute exit opening.

In some aspects, a pump assembly includes a pump casing having a pump housing and a motor pot. An open end of the pump housing is joined to an open end of the motor pot. The joined pump housing and motor pot define an interior fluid chamber. In addition, the pump assembly includes an impeller disposed in the fluid chamber, the impeller being rotatable about a rotational axis. The pump housing includes a primary inlet that defines a first passageway that is aligned with the rotational axis and directs fluid toward the impeller. The pump housing includes a primary outlet that defines a second passageway that is aligned with a second axis. In addition, the pump housing includes a volute that is provided on an inner surface of the pump housing. The volute is configured to receive fluid from the primary inlet and direct the received fluid toward the primary outlet. The volute defines a spiral fluid path that increases in cross-sectional area along the path so as to have a maximum cross-sectional area at a volute exit opening. The volute exit opening faces the primary outlet. The volute exit opening discharges at least a portion of the fluid along a volute discharge axis. An end face of the motor pot open end defines a floor surface of the volute, the end face residing in a plane that is substantially perpendicular to the rotational axis. In addition, an inner surface of the outlet has a ramp configured to redirect fluid flow exiting the volute so that the redirected fluid flow is at an acute first angle relative to the plane.

In some embodiments, the ramp has a surface that faces the volute exit opening, the surface being at the first angle relative to the plane.

In some embodiments, when viewed in a direction parallel to the rotational axis, the volute discharge axis is tangential to a portion of fluid flow exiting the volute at the volute exit opening. In addition, the second axis is aligned with the volute discharge axis.

In some embodiments, the volute discharge axis is at an acute second angle relative to the plane, and the first angle is greater than the second angle.

In some embodiments, the first angle is at least twice the second angle.

In some embodiments, the first angle is in a range of 5 degrees to 20 degrees.

In some embodiments, a cross-sectional area of the primary outlet increases along the second passageway, and the primary outlet has a minimum dimension at a location closest to the volute exit opening.

In some embodiments the pump assembly includes a secondary housing that encloses at least a portion of the pump housing. The secondary housing includes a secondary inlet that is configured to direct fluid into the primary fluid inlet, and a secondary outlet that is configured to receive fluid from the primary fluid outlet.

In some embodiments, the secondary outlet defines a discharge fluid passageway, and at least a portion of the discharge fluid passageway is substantially parallel to and axially offset relative to the volute discharge axis.

In some embodiments, the secondary outlet defines a discharge fluid passageway. The discharge fluid passageway includes a portion in which a cross-sectional area of the portion increases along the portion. In addition, the portion has a minimum dimension at a location closest to the primary outlet.

In some embodiments, the pump assembly includes a second seal and a third seal. The second seal encircles an outer surface of the primary inlet and provides a fluid-tight seal between the outer surface of the primary inlet and an inner surface of the secondary housing, and the third seal that encircles an outer surface of the primary pump housing and provides a fluid tight seal between the outer surface of the primary pump housing and the inner surface of the secondary housing.

In some embodiments, the secondary outlet is configured to communicate with an interior space of the fluid pump that is defined between the inner surface of the secondary housing, an outer surface of the primary housing, the second seal and the third seal.

DETAILED DESCRIPTION

Figure 1:
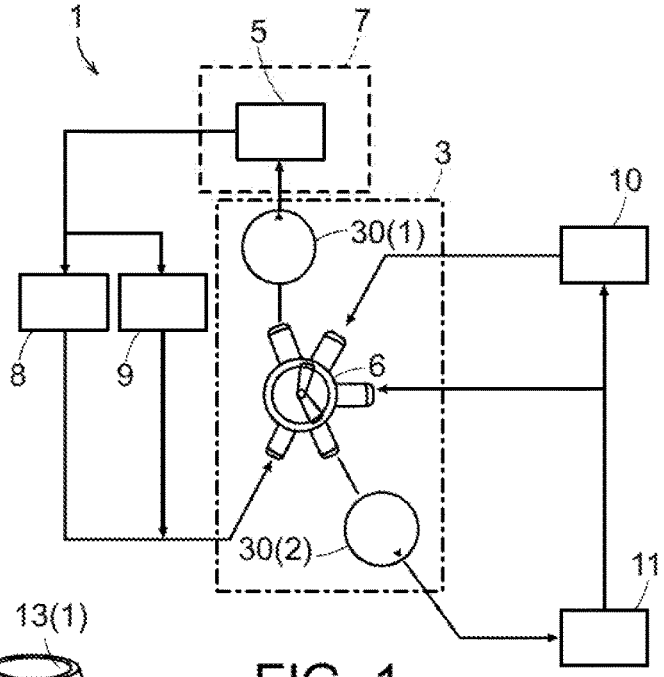
FIG. 1 is a schematic diagram illustrating a fluid delivery system that includes an integrated module employing volute-type centrifugal fluid pumps configured to drive fluid therein.
Figure 2:
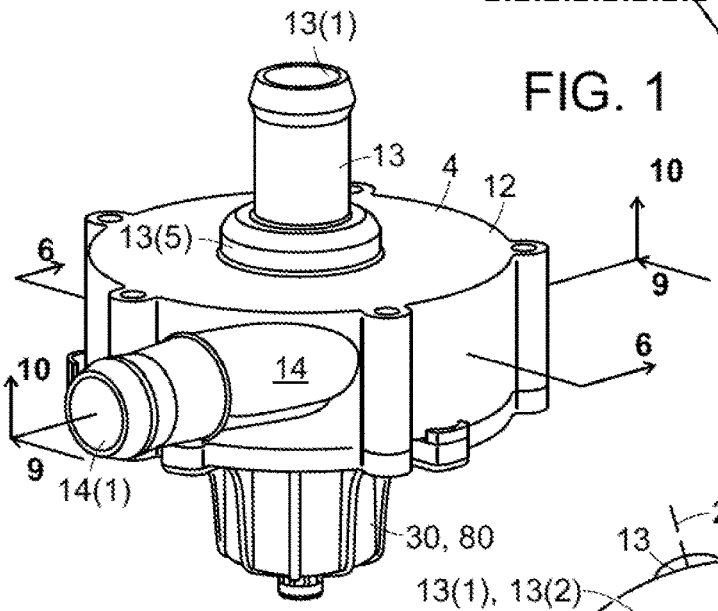
FIG. 2 is a perspective view of the assembly that includes secondary housing and the wet portion of the pump disposed in a recess of the secondary housing.
Figure 3:
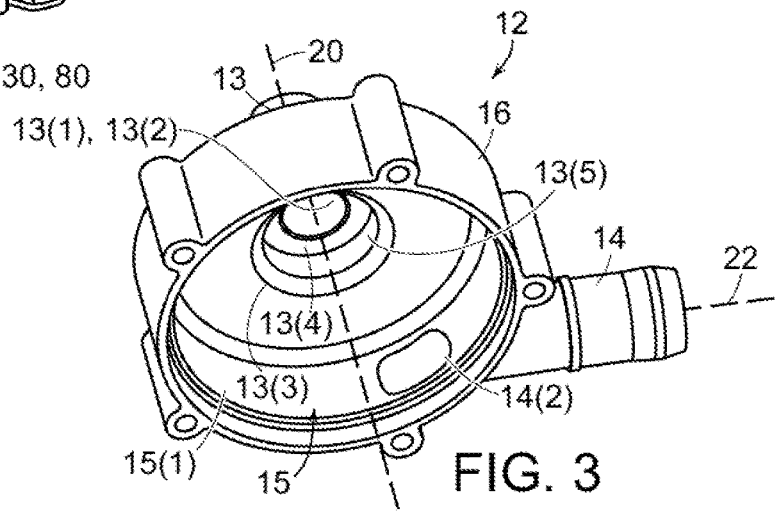
FIG. 3 is a perspective view of the secondary housing.
Figure 4:
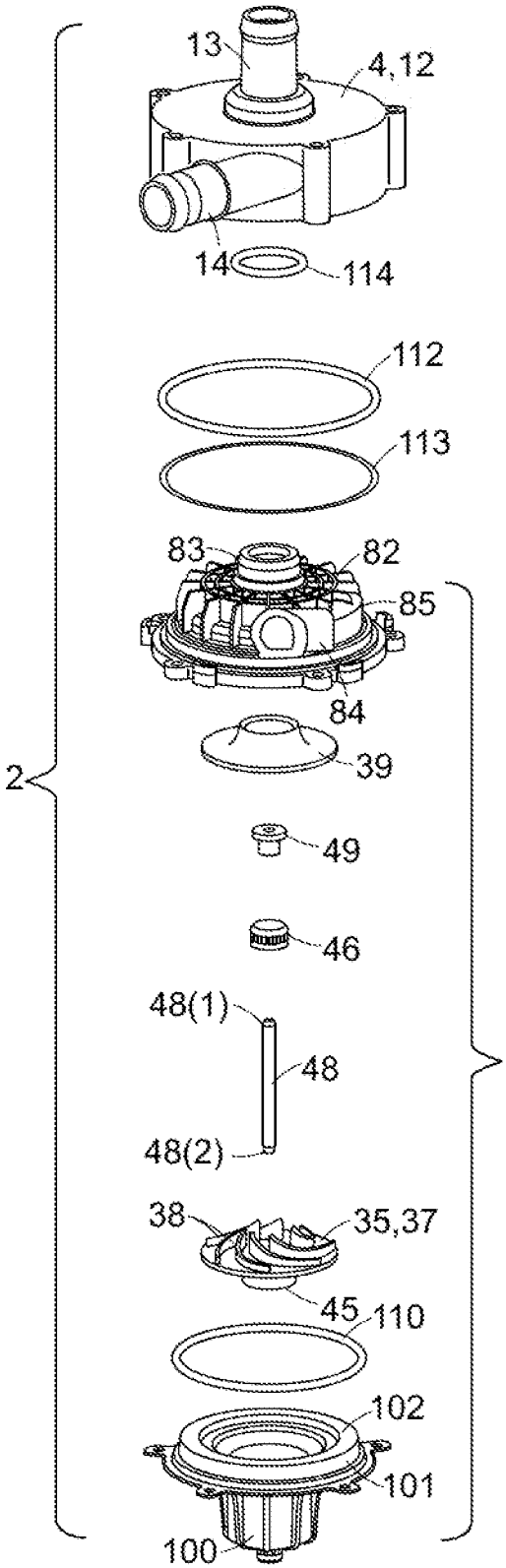
FIG. 4 is an exploded view of the assembly of FIG. 2.

Referring to FIGS. 1-4, a fluid delivery system 1 includes a multi-port rotary valve 6 that is capable of controlling fluid flow driven by one or more volute-type centrifugal fluid pumps 30 between three, four, five or more individual fluid lines within the system 1. The rotary valve 6 may be used, for example, to control the distribution and flow of coolant in a vehicle cooling system 1 of an electric vehicle. In this example, a first pump 30(1) may drive coolant fluid between the rotary valve 6 and a radiator 5 that is part of a vehicle passenger cabin heating and cooling system 7, where coolant from the radiator 5 may also cool a battery 8 and battery management system 9. In addition, a second pump 30(2) may drive coolant fluid to heat exchangers 10, 11 that support temperature control of other vehicle devices and systems, such as an electric drive motor, vehicle electronics and/or electronic control units and/or the oil supply. In some vehicles, several components of the fluid delivery system may be integrated into a single module 3 that provides integrated cooling functionality. The module 3 may include the pumps 30(1), 30(2), the valve 6, a fluid reservoir (not shown), sensors (not shown), a controller (not shown) as well as other ancillary components and devices into a module housing 4. In FIGS. 2-4, 6, 9 and 10, only a portion 12 of the module housing 4 is shown and will be referred to herein as the secondary housing 12. The secondary housing 12 is the portion of the module housing 4 that receives and retains the pump housing 82 of the pump 30. The pump housing 82, also referred to as the primary housing 82, includes structural features that allow it to be coupled to the secondary housing 12 while optimizing pump performance and minimizing pressure losses. The assembly 2 that includes the secondary housing 12 and the pump 30 will now be described in detail.

The secondary housing 12 includes a recess 15 provided in an outer surface 16 thereof. The recess 15 is shaped and dimensioned to receive the pump housing (primary housing) 82 of the pump 30 in a clearance fit. The secondary housing 12 also includes a secondary inlet 13 and a secondary outlet 14. Each of the secondary fluid inlet 13 and the secondary fluid outlet 14 are in fluid communication with the recess 15 and are configured to direct fluid to and from the recess 15.

In the illustrated embodiment, the secondary inlet 13 and the secondary outlet 14 are shown as protruding tubular structures that are shaped to permit connection to an external fluid hose (not shown). In other embodiments, the secondary inlet 13 and the secondary outlet 14 may be implemented as internal tubular fluid passageways, e.g., as internal vacancies within the secondary housing 12.

Referring to FIGS. 2-3, 6 and 9, an inner surface 13(1) of the secondary inlet 13 is cylindrical and defines a secondary inlet passageway 13(2). The secondary inlet 13 includes a step change in internal diameter at a location closely adjacent to the recess 15. In particular, the secondary fluid inlet 15 has an enlarged diameter portion 13(5) at the intersection 13(3) with the recess 15, and a shoulder 13(4) is formed at the transition between the enlarged diameter portion 13(5) and the remainder of the secondary fluid inlet 13.

An inner surface 14(1) of the secondary fluid outlet 14 has a circular cross-sectional shape at any point along its length, and the area of the cross-section is a minimum at the intersection 14(2) with the recess 15. The secondary fluid outlet includes uniform diameter portion 14(3) and a diffuser portion 14(4) that extends between the uniform diameter portion 14(3) and the recess 15. The diffuser portion 14(4) has a gradually and smoothly increasing inner diameter, with a maximum diameter disposed at a location 14(5) that is remote from the intersection 14(2) with the recess 15. The length of the diffuser portion 14(4) is determined by the requirements of the specific application. In the illustrated embodiment, a midline of the diffuser portion 14(4) is slightly curved, whereas the uniform diameter portion 14(3) is linear. In addition, the uniform diameter portion 14(3) of the secondary outlet 14 defines a secondary outlet axis 22 that is perpendicular to, or substantially perpendicular to, and offset from a secondary inlet axis 20 defined by the secondary inlet 13.

Figure 5:
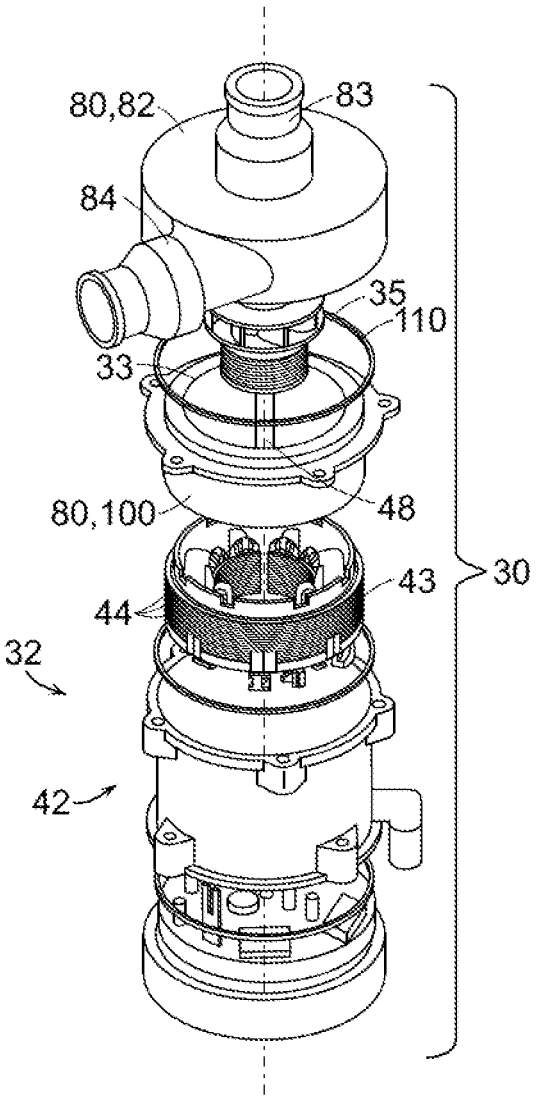
FIG. 5 is an exploded view of a volute-type centrifugal fluid pump.
Figure 6:
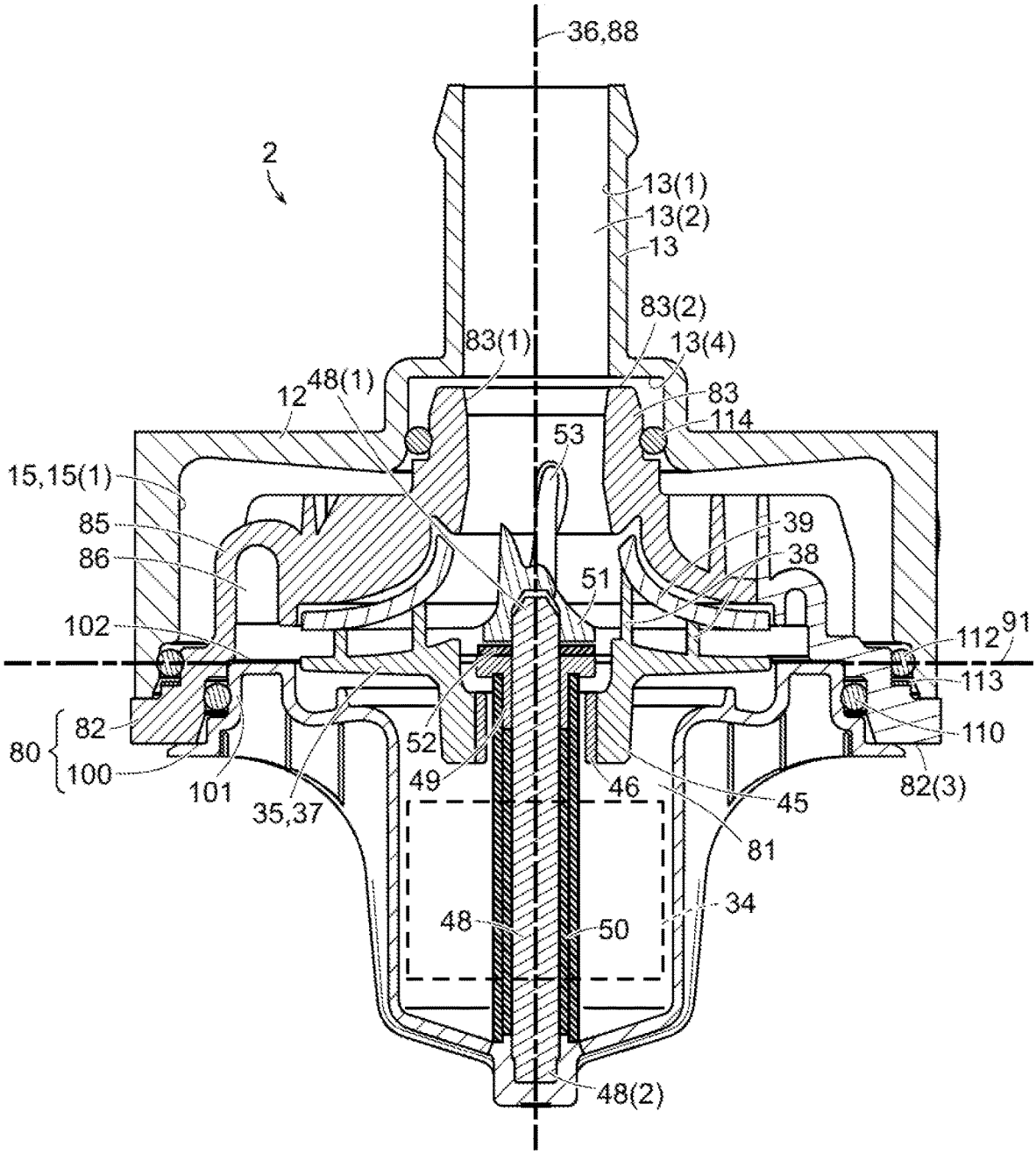
FIG. 6 is a cross sectional view of the assembly as seen along line 6-6 of FIG. 2.
Figure 7:
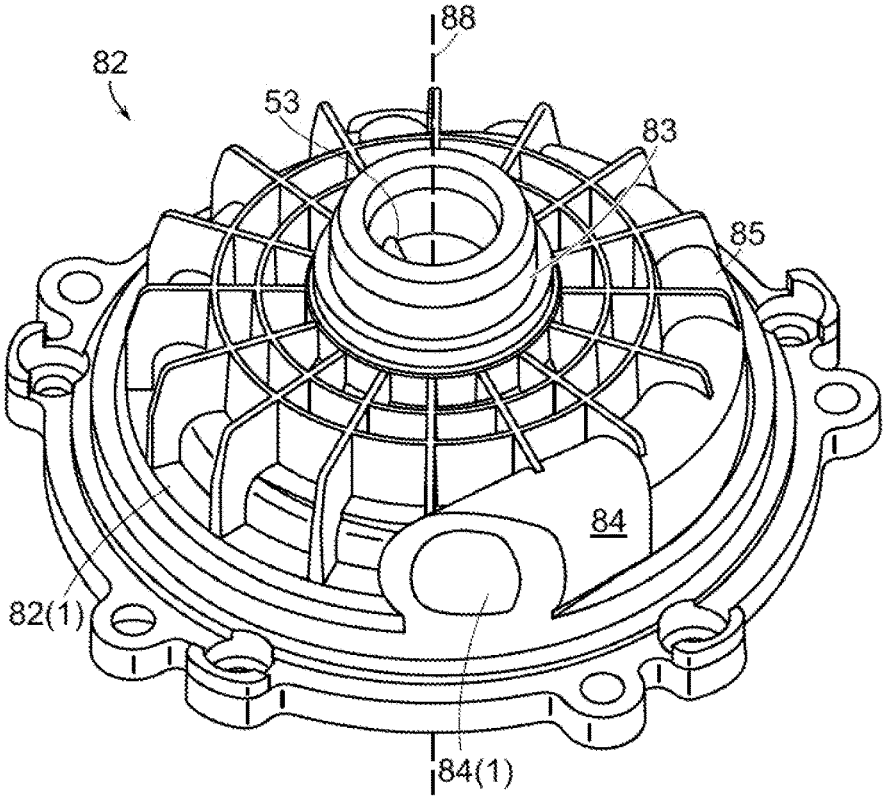
FIG. 7 is a top perspective view of the pump housing.
Figure 8:
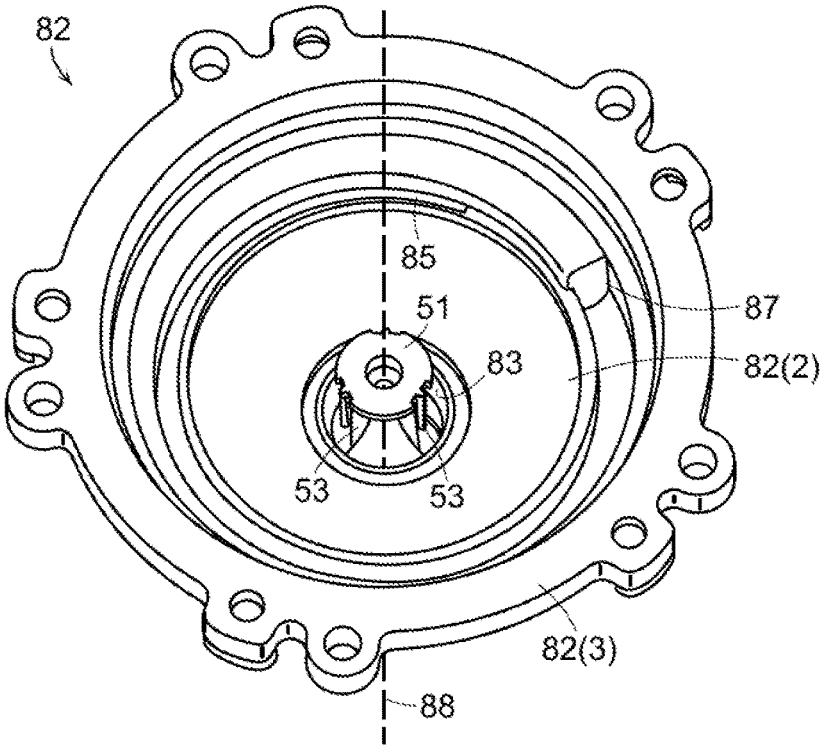
FIG. 8 is a bottom perspective view of the pump housing.

Referring to FIGS. 5-6, the volute-type centrifugal fluid pump 30 includes a pump casing 80 that defines a "wet area" through which fluid is pumped, and an electric drive 32 that drives the pump 30. The pump casing 80 is formed by a first casing part referred to as the pump housing 82 and a second casing part referred to as the motor pot 100. The pump housing 82 and the motor pot 100 are concave structures that, when assembled together, form an enclosed fluid chamber 81. The fluid chamber 81 forms the wet area of the pump 30. The motor pot 100 separates the wet area from the dry area, which includes most components of the electric drive 32. The pump casing 80 will be described in detail below following the description of the electric drive 32.

The electric drive 32 has a rotor unit 33, a stator 43 and includes control electronics which are referred to generally by reference number 42. In FIG. 5, the electric drive 32 is shown schematically. Since the structure and functionality of a suitable electric motor are sufficiently known from the prior art, a detailed description of the electric drive 32 is omitted for the sake of brevity and simplicity of the description.

The rotor unit 33 is disposed in the fluid chamber 81 and includes a rotor 34 (the rotor 34 is shown schematically in FIG. 6 using broken lines) and an impeller 35, which are connected to one another in a rotationally fixed manner whereby movement of the rotor 34 is transmitted to the impeller 35. When the pump 30 is in operation, the rotor unit 33 conveys fluid through the wet area by means of the impeller 35.

The stator 43 is disposed outside the motor pot 100 (e.g., the stator 43 is disposed in the dry area) and is controlled by the control electronics 42. The stator 43 includes a plurality of coils 44 that surround the motor pot 100 in the vicinity of the rotor 34 along the circumference of the rotor 34. When the electric drive 32 is in operation, the stator coils 44 generate a rotating magnetic field, by means of which the rotor unit 33 is driven to rotate about a rotational axis 36.

The rotor unit 33 is rotatably mounted on a pump shaft 48 via bearings 49, 50. The pump shaft 48 is fixed relative to the pump casing 80. In some embodiments, the bearing 50 (omitted from FIG. 4) is designed as a slide bearing or as a slide bushing. The rotational axis 36 runs through the center of the pump shaft 48 in the axial direction and thus corresponds to the center axis of the pump shaft 48.

A first end 48(1) of the pump shaft 48 faces the pump housing primary inlet 83 and is connected in a rotationally fixed manner to a stop element 51 that protrudes from an inner surface of the pump housing 82 so as to be centered on the rotational axis 36 in the vicinity of the primary inlet 83. In particular, the bearing 49 is provided on the shaft first end 48(1), and the sliding bearing 50 surrounds the pump shaft 48 and extends between the motor pot 100 and the bearing 49. The stop element 51 is part of a bearing point for the rotor unit 33 and prevents the pump shaft 48 from moving in the radial and axial directions. The stop element 51 has a circular profile and is connected to the pump casing 80 via holding webs 53. The holding webs 53 are arranged on the circumference of the stop element 51 and are connected to the inner surface of the pump housing primary inlet 83. At the opposite end 48(2), the pump shaft 48 is fixed relative to an inner surface of the motor pot 100, for example by insert molding. The stop element 51 minimizes or restricts a deflection of the bearing 49 or the sliding bearing 50 in the axial direction and, as a result, an axial deflection of the impeller 35. During operation, such an axial deflection of the impeller 35 may be generated, for example, by the axial thrust of the rotor 34.

The slide bearing 50 is designed as part of the rotor 34 and thus moves (e.g., rotates) relative to the stop element 51 during operation. In order to minimize the high frictional forces between the slide bearing 50 and the stop element 51 as well as the associated sluggishness of the rotor 34 and the resulting wear of the stop element 51, a thrust washer 52 is provided between the stop element 51 and the bearing 49. The thrust washer 52 is preferably designed in such a way that there is a friction-optimized material pairing between the thrust washer 52 and the bearing 49.

The impeller 35 is connected to the rotor 34 via a metal insert 46 disposed in the hub 45 of the impeller 35. By this configuration, the impeller 35 rotates about the rotational axis 36 in concert with the rotor 34. The impeller 35 includes a base plate 37, the hub 45 that is centered on the base plate 37 and protrudes from one side thereof, impeller blades 38 that protrude from the opposite side of the base plate 37, and a curved shroud 39. The base plate 37 extends as a substantially flat disk in the radial direction. The impeller blades 38 are arranged on the base plate 37 and extend in a spiral around the rotational axis 36. The impeller blades 38 are arranged between the base plate 37 and the shroud 39 and face the primary inlet 83. The impeller 35 is arranged within the fluid chamber 81 such that the base plate 37 is disposed at the open end of the motor pot 100 and the shroud 39 is disposed between the base plate 37 and the pump housing 82 so as to overlie the impeller blades 38. In particular, an outer surface of the shroud 39 faces, and is closely spaced relative to, an inner surface of the pump housing 82. The shroud 39 includes a central opening 40 that faces the primary inlet 83 of the pump housing 82. The central opening 40 permits fluid from the inlet 83 to be directed into the impeller blades 38. The shroud 39 is designed to taper in the direction of the inlet 83. The impeller 35 is arranged concentrically with the rotational axis 36 and redirects the main volume flow of the fluid out of the fluid chamber 81 in the radial direction via a volute 85 that is incorporated into the pump housing 82.

The motor pot 100 is a cup shaped structure including an open end 101 that faces the pump housing 82. The end face 102 of the open end 101 substantially resides in a radial first plane 91.

Referring to FIGS. 4 and 6-10, the pump housing (primary housing) 82 is a generally cup shaped structure having an open end 82(3) that faces the motor pot 100. The pump housing 82 that includes the primary inlet 83, a primary outlet 84 and a volute 85. The fluid is drawn in via the primary inlet 83 and then discharged via the primary outlet 84. A main volume flow of the fluid flows in through the primary inlet 83 in an axial direction into the fluid chamber 81 and then out of the fluid chamber 81 via the outlet in an outflow direction that is angled relative to a direction of fluid flow of fluid exiting the volute 85, as will be described in detail below.

The primary inlet 83 is a tubular structure that protrudes from an outer surface 82(1) of the pump housing 82 and defines a primary inlet passageway 83(1). When viewed in a direction parallel to the rotational axis 36, the primary inlet passageway 83(1) has a circular cross-sectional shape that is centered on the rotational axis 36. The diameter of this cross-section smoothly varies in the axial direction so that an inner diameter of the primary inlet 83 is slightly greater at the opposed ends of the primary inlet 83 than at a midpoint of the primary inlet 83. Thus, the primary inlet 83 extends along a primary inlet axis 88 that coincides with the rotational axis 36.

The volute 85 is defined on an inner surface 82(2) of the primary pinup housing 82. The volute 85 forms a spiral fluid path 86 centered on the primary inlet 83 and is configured to efficiently collect fluid from the impeller 35. The spiral fluid path 86 partially encircles the rotational axis 36. Although the arc length of the spiral fluid path 86 is determined by the requirements of the specific application, an exemplary spiral fluid path 86 may have an arc length of about 330 degrees.

The volute 85 is open so as to face the end face 102 of the motor pot 100, whereby the motor pot end face 102 provides a floor surface of the spiral fluid path 86 that resides in the first plane 91. The first plane 91 is perpendicular to, or substantially perpendicular to, the primary inlet axis 88 whereby the spiral fluid path 86 lies in a radial plane. The spiral fluid path 86 increases in cross-sectional area along the spiral fluid path 86 so as to have a maximum cross-sectional area at a volute exit opening 87. The volute exit opening 87 faces the primary outlet 84 and is configured to discharge fluid along a volute discharge axis 90 toward the primary outlet 84.

The primary outlet 84 is non-parallel to, and non-intersecting with, the primary inlet 83, and provides a fluid passageway 84(1) that directs fluid from the volute 85 to the secondary outlet 14 of the secondary housing 12. The primary outlet 84 is a tubular structure that protrudes from an outer surface 82(1) of the pump housing 82 and defines a primary outlet passageway 84(1). When viewed in a direction parallel to a radial plane, the primary outlet passageway 84(1) has a circular cross-sectional shape. The diameter of this cross-section smoothly increases along the length of the primary outlet 84 so that a diameter of the primary outlet passageway 84(1) is a maximum at an end 84(2) closest to the secondary housing 12 and furthest from the volute exit opening 87. In the assembly 2, the pump housing 82 is disposed in the secondary housing recess 15 in such a way that the primary outlet 84 is in fluid communication with the secondary outlet 14, and the diffuser portion 14(4) of the secondary outlet 14 and the primary outlet 84 together form a diffuser of the assembly 2.

Figure 9:
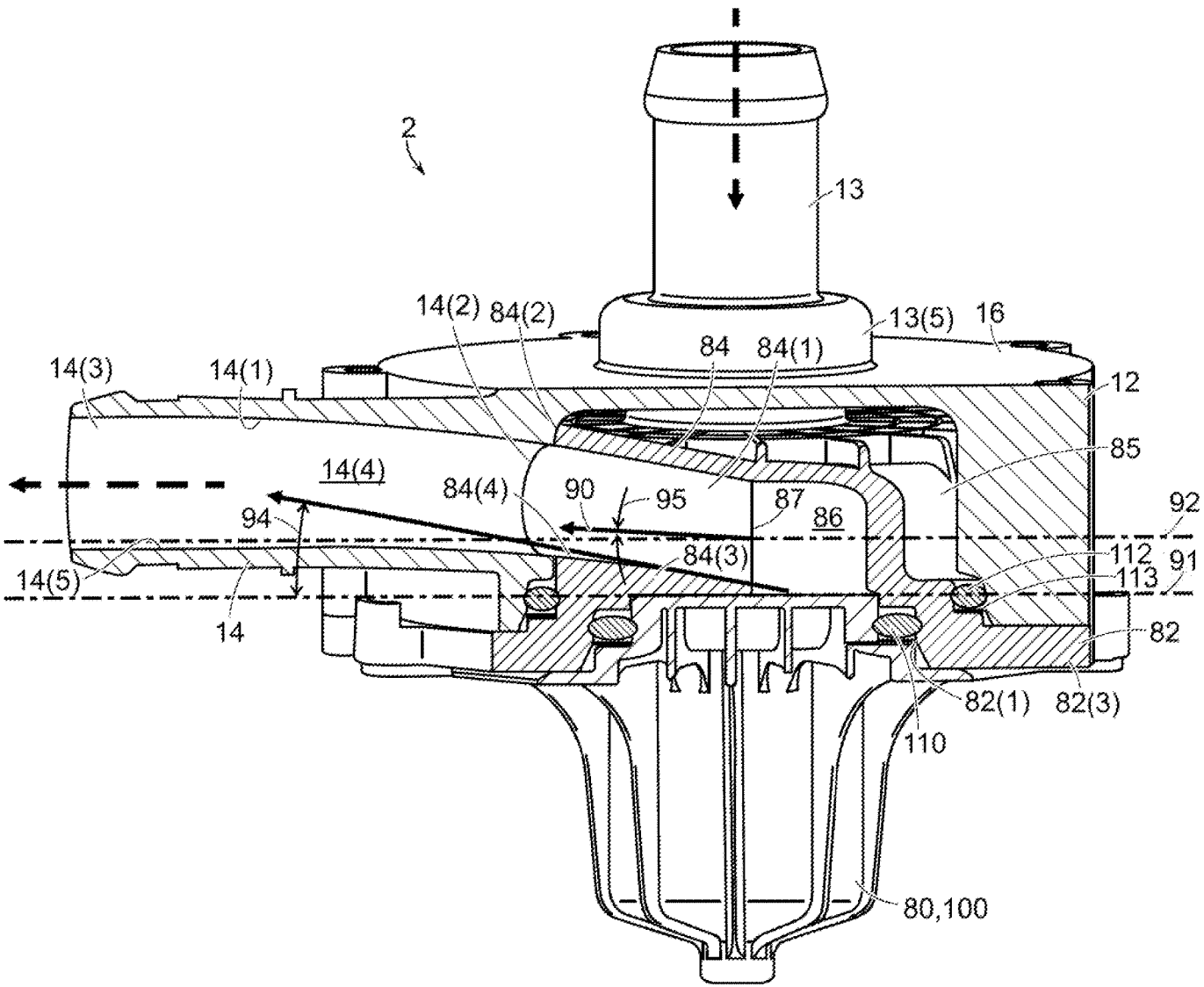
FIG. 9 is a cross sectional view of the assembly as seen along line 9-9 of FIG. 2.
Figure 10:
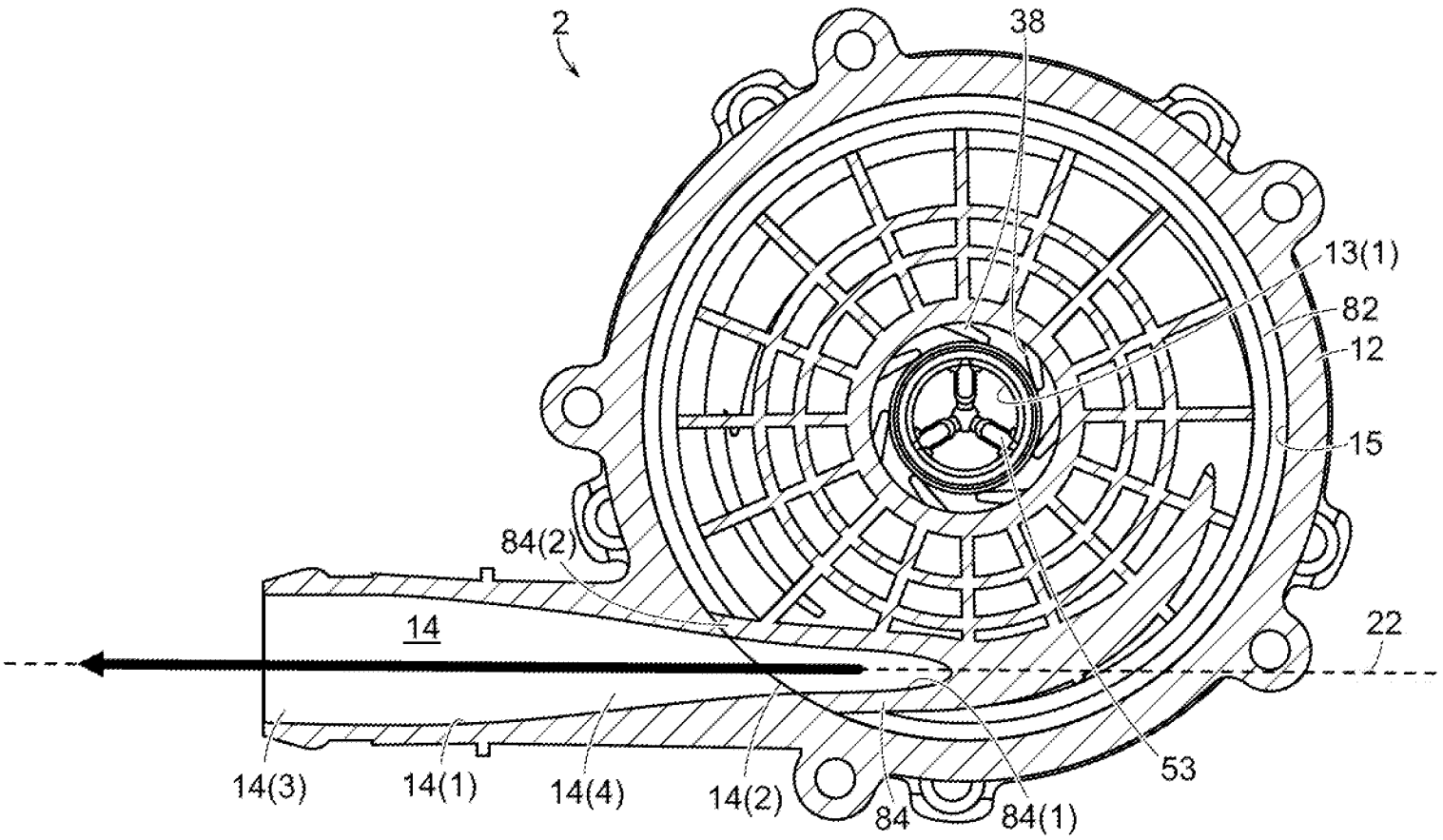
FIG. 10 is a cross sectional view of the assembly as seen along line 10-10 of FIG. 2.
Figure 11:
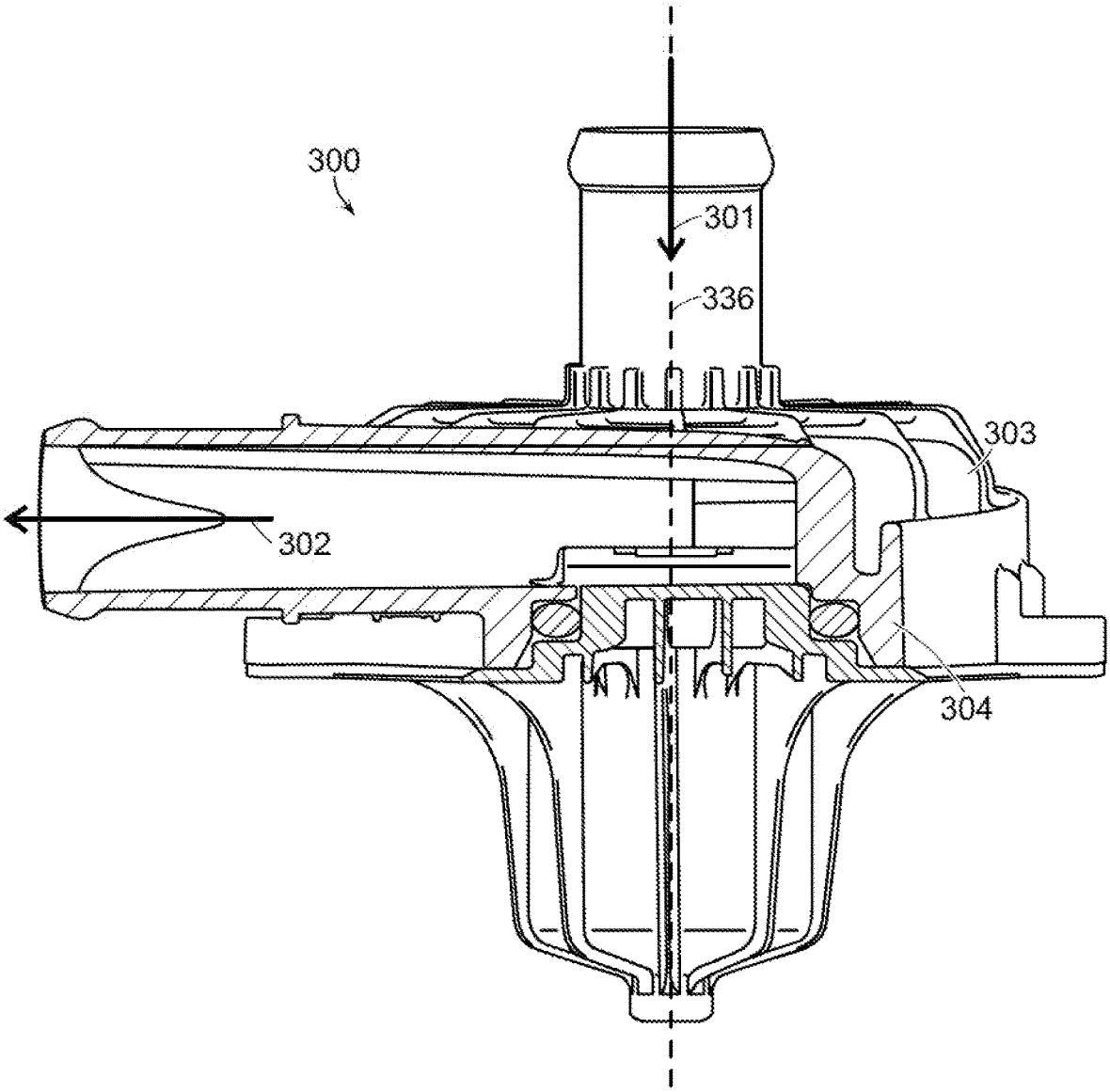
PRIOR ART FIG. 11
FIG. 11 is a cross sectional view of a prior art centrifugal fluid pump.

Referring to FIGS. 6 and 9, the pump housing 82 and the motor pot 100 are retained in the assembled configuration shown via fasteners (not shown). The pump 30 includes an annular first seal 110 that is disposed between the motor pot 100 and the pump housing 82. The first seal 110 is disposed on an outer periphery of the motor pot 100 so as to surround the end face 102 of the open end 101. In addition, the first seal 110 abuts an inner surface 82(2) of the primary pump housing 82 so as to surround the volute 85 in a radial plane. The first seal 110 provides a fluid-tight seal between the pump housing 82 and the motor pot 100.

The pump 30 is assembled with the secondary housing 12 by inserting the pump housing 82 into the secondary housing recess 15 with an outer surface 82(1) of the pump housing 82 facing the surface 15(1) of the recess 15. In the assembly 2, the primary inlet 83 protrudes into the enlarged diameter portion 13(2) of the secondary inlet 13, and an end face 83(2) of the primary inlet 83 abuts the shoulder 13(4). The secondary inlet axis 20, the primary inlet axis 88 and the rotational axis 36 are substantially coaxial. A second seal 114 surrounds the outer surface of the primary inlet 83 and abuts an inner surface of the enlarged diameter portion 13(2). The second seal 114 provides a fluid-tight seal between the primary inlet 83 of the pump housing 82 and the secondary inlet 13 of the secondary housing 12.

The assembly 2 includes a third seal 112 that that encircles an outer surface 82(1) of the primary pump housing 82 at a location that is adjacent the pump housing open end 82(3). In particular, the third seal 112 is disposed between the pump housing open end 82(3) and the primary outlet 84. The third seal 112 provides a fluid tight seal between the pump housing outer surface 82(1) and the inner surface of the secondary housing 12 (e.g., and the surface 15(1) of the recess 15. By this arrangement, the primary outlet 84 is disposed between the second seal 114 and the third seal 112. A thin, annular metal gasket 113 may be interposed between the third seal 112 and a portion of the pump housing 82. The gasket 113 does not provide a sealing function and instead protects the third seal 112 from unintended wear due to the presence of fasteners (not shown, and used to secure the pump housing 82 to the secondary housing 12) in this vicinity.

The primary outlet 84 provides the fluid passageway 84(1) that directs fluid from the volute 85 to the secondary outlet 14 of the secondary housing 12. In the assembly 2, the primary outlet 84 extends between the volute exit opening 87 and the secondary outlet 14. Due to the presence of the first seal 110 between the outer surface 82(1) of the pump housing (primary housing) 82 and the surface 15(1) of the recess 15, the secondary outlet 14 is axially offset relative to the first plane 91 which includes the spiral fluid path 86. In order to accommodate the axial offset of the secondary outlet 14, the inner surface of the primary outlet 84 provides a ramp 84(3) that redirects fluid flow from the volute discharge axis 90 toward the secondary outlet 14. In particular, a surface 84(4) of the ramp 84(3) that faces the volute exit opening 87 is at an acute first angle 94 relative to the first plane 91. As a result, when the assembly 2 is viewed in a direction perpendicular to the rotational axis 36, the primary outlet 84 (e.g., an axis defined by the outlet passageway 84(1)) extends at the first angle 94 relative to the first plane 91. In some embodiments, the first angle 94 may be in a range of 5 degrees to 20 degrees. In other embodiments, the first angle 94 may be in a range of 7 degrees to 18 degrees. In still other embodiments, the first angle 94 may be approximately 12 degrees.

By providing the ramp 84(3) that angles fluid flow exiting the volute at an acute angle relative to the radial plane, a step change in the fluid passageway 84(1) is avoided. However, molding the pump housing 82 in such a way as to smoothly redirect the fluid is challenging. In particular, the ramp 84(3) requires a slide (not shown) in the injection mold (not shown) which must be removed from the tool along a straight line. By angling the flow after the volute where it is now tangent and expanding through the assembly diffuser, a straight vector is provided that permits removal of the slider, and also permits allows implementation of the ramp 84(3) as compared to an abrupt step.

As previously mentioned, the volute exit opening 87 faces the primary outlet 84 and is configured to discharge fluid along a volute discharge axis 90 toward the primary outlet 84. Because the spiral fluid path 86 increases in cross-sectional area along the spiral fluid path 86 and because the floor of the spiral fluid path 86 lies in a radial plane (e.g. the first plane 91), the volute discharge axis 90 is slightly non-parallel to a radial plane 92 when viewed in a direction perpendicular to the rotational axis 36 (FIG. 9). In particular, the volute discharge axis 90 is at a small, acute second angle 95 relative to the radial plane 92. The second angle 95 corresponds to approximately half the angle of expansion of the volute 85, where the angle of expansion of the volute 85 approximately corresponds to the inverse tangent of [(the diameter of the volute exit opening 87) divided by (the length of the spiral fluid path 86)]. In the illustrated embodiment, for example, the second angle 95 is about two degrees. The second angle 95 is small relative to the first angle 94. For example, the first angle 94 may be in a range of two to five times the second angle 95.

In addition, when viewed in a direction parallel to the rotational axis 36 (FIG. 10), a portion of the fluid exiting the volute exit opening 87 flows in direction that is tangential to the spiral curve at the volute exit opening 87. Depending on the flow velocity of the fluid exiting the volute 85, the portion of the fluid that flows tangentially may be located along the radial innermost wall of the volute 85, along the radial outermost wall of the volute 85 or along the mean line of the volute 85. For purposes of discussion, it will be assumed that the flow velocity of the fluid exiting the volute 85 is appropriate to provide a tangential direction of fluid flow along the mean line of the volute 85 for at least a portion of the fluid exiting the volute 85, in particular for a main volume of fluid exiting the volute 85. The fluid flow direction is represented by an arrow in FIG. 10.

By this configuration, the secondary housing 12 encloses at least a portion of the pump housing 82, the secondary inlet 13 directs fluid into the primary inlet 82 and the secondary outlet 14 receives fluid from the primary outlet 84. To this end, the secondary outlet 14 is in fluid communication with an interior space of the assembly 2 that is defined between the inner surface 15(1) of the secondary housing 12, an outer surface 82(1) of the pump housing 82, the second seal 114 and the third seal 112.

Selective illustrative embodiments of the vehicle cooling system including the pump assembly are described above in some detail. It should be understood that only structures considered necessary for clarifying the fluid delivery system and the pump assembly have been described herein. Other conventional structures, and those of ancillary and auxiliary components of the vehicle cooling system and the pump assembly, are assumed to be known and understood by those skilled in the art. Moreover, while a working example of the vehicle cooling system and the pump assembly have been described above, the vehicle cooling system and the pump assembly are not limited to the working example described above, but various design alterations may be carried out without departing from the vehicle cooling system and/or the pump assembly as set forth in the claims.

What is claimed is:

1. A centrifugal pump comprising:

a pump casing that includes a pump housing and a motor pot, an open end of the pump housing being joined to an open end of the motor pot, the joined pump housing and motor pot defining an interior fluid chamber, and a rotor unit disposed in the fluid chamber, the rotor unit including a rotor of a motor and an impeller that is connected to the rotor, the rotor configured to drive the impeller to rotate about a rotational axis, wherein the pump housing includes an inlet that defines a first passageway that is aligned with the rotational axis and directs fluid toward the impeller, an outlet that defines a second passageway that is aligned with a second axis, and a volute that is provided on an inner surface of the pump housing and that communicates with the inlet and the outlet, the volute defining a spiral fluid path that increases in cross-sectional area along the path so as to have a maximum cross-sectional area at a volute exit opening, the volute exit opening facing the outlet, the volute exit opening discharging at least a portion of the fluid along a volute discharge axis, and wherein the outlet is disposed downstream of the volute exit opening, an end face of the motor pot open end defines a floor surface of the volute, the end face residing in a plane that is substantially perpendicular to the rotational axis, and an inner surface of the outlet has a ramp configured to redirect fluid flow exiting the volute so that the redirected fluid flow is at an acute first angle relative to the plane.

2. The centrifugal pinup of claim 1, wherein the ramp has a surface that faces the volute exit opening, the surface being at the first angle relative to the plane.

3. The centrifugal pump of claim 1, wherein when viewed in a direction parallel to the rotational axis, the volute discharge axis is tangential to a portion of fluid flow exiting the volute at the volute exit opening and the second axis is aligned with the volute discharge axis.

4. The centrifugal pump of claim 1, wherein the volute discharge axis is at an acute second angle relative to the plane, and the first angle is greater than the second angle.

5. The centrifugal pump of claim 4, wherein the first angle is at least twice the second angle.

6. The centrifugal pump of claim 1, wherein the first angle is in a range of 5 degrees to 20 degrees.

7. The centrifugal pump of claim 1, wherein a cross-sectional area of the outlet increases along the second passageway, and the outlet has a minimum dimension at a location closest to the volute exit opening.

8. A pump assembly comprising:

a pump casing that includes a pump housing and a motor pot, an open end of the pump housing being joined to an open end of the motor pot, the joined pump housing and motor pot defining an interior fluid chamber, and an impeller disposed in the fluid chamber, the impeller being rotatable about a rotational axis, wherein the pump housing includes a primary inlet that defines a first passageway that is aligned with the rotational axis and directs fluid toward the impeller, a primary outlet that defines a second passageway that is aligned with a second axis, and a volute that is provided on an inner surface of the pump housing, the volute configured to receive fluid from the primary inlet and direct the received fluid toward the primary outlet, the volute defining a spiral fluid path that increases in cross-sectional area along the path so as to have a maximum cross-sectional area at a volute exit opening, the volute exit opening facing the primary outlet, the volute exit opening discharging at least a portion of the fluid along a volute discharge axis, and wherein the primary outlet is disposed downstream of the volute exit opening, an end face of the motor pot open end defines a floor surface of the volute, the end face residing in a plane that is substantially perpendicular to the rotational axis, and an inner surface of the outlet has a ramp configured to redirect fluid flow exiting the volute so that the redirected fluid flow is at an acute first angle relative to the plane.

9. The pump assembly of claim 8, wherein the ramp has a surface that faces the volute exit opening, the surface being at the first angle relative to the plane.

10. The pump assembly of claim 8, wherein when viewed in a direction parallel to the rotational axis, the volute discharge axis is tangential to a portion of fluid flow exiting the volute at the volute exit opening, and the second axis is aligned with the volute discharge axis.

11. The pump assembly of claim 8, wherein the volute discharge axis is at an acute second angle relative to the plane, and the first angle is greater than the second angle.

12. The pump assembly of claim 11, wherein the first angle is at least twice the second angle.

13. The pump assembly of claim 8, wherein the first angle is in a range of 5 degrees to 20 degrees.

14. The pump assembly of claim 8, wherein a cross-sectional area of the primary outlet increases along the second passageway, and the primary outlet has a minimum dimension at a location closest to the volute exit opening.

15. The pump assembly of claim 8, comprising a secondary housing that encloses at least a portion of the pump housing, the secondary housing including a secondary inlet that is configured to direct fluid into the primary fluid inlet, a secondary outlet that is configured to receive fluid from the primary fluid outlet.

16. The pump assembly of claim 15, wherein the secondary outlet defines a discharge fluid passageway, and at least a portion of the discharge fluid passageway is substantially parallel to and axially offset relative to the volute discharge axis.

17. The pump assembly of claim 15, wherein the secondary outlet defines a discharge fluid passageway, the discharge fluid passageway includes a portion in which a cross-sectional area of the portion increases along the portion, and the portion has a minimum dimension at a location closest to the primary outlet.

18. The pump assembly of claim 15, comprising a second seal that encircles an outer surface of the primary inlet and provides a fluid-tight seal between the outer surface of the primary, inlet and an inner surface of the secondary housing, and a third seal that encircles an outer surface of the primary pump housing and provides a fluid tight seal between the outer surface of the primary pump housing and the inner surface of the secondary housing.

19. The pump assembly of claim 18, wherein the secondary outlet is configured to communicate with an interior space of the fluid pump that is defined between the inner surface of the secondary housing, an outer surface of the primary housing, the second seal and the third seal.

* * * * *